US010401126B1

(12) United States Patent
Kolomijez et al.

(10) Patent No.: US 10,401,126 B1
(45) Date of Patent: Sep. 3, 2019

(54) BALLISTIC PRESENTATION BOARD ASSEMBLY

(71) Applicant: SAFE PLACE SOLUTIONS LLC, Maple Heights, OH (US)

(72) Inventors: David J. Kolomijez, Parma Heights, OH (US); Michael S. Georgiadis, Lyndhurst, OH (US); James E. Somogyi, Northfield Center, OH (US); Joseph M. Shoemaker, Poland, OH (US); Herbert C. Neides, Gates Mills, OH (US)

(73) Assignee: SAFE SPACE SOLUTION, LLC, Maple Heights, OH (US)

( * ) Notice: Subject to any disclaimer, the term of this patent is extended or adjusted under 35 U.S.C. 154(b) by 179 days.

(21) Appl. No.: 15/493,881

(22) Filed: Apr. 21, 2017

Related U.S. Application Data

(60) Provisional application No. 62/326,387, filed on Apr. 22, 2016.

(51) Int. Cl.
*B43L 1/00* (2006.01)
*F41H 5/06* (2006.01)

(52) U.S. Cl.
CPC . *F41H 5/06* (2013.01); *B43L 1/00* (2013.01)

(58) Field of Classification Search
USPC ..... 434/408, 416, 428, 430; 40/606.01, 40/606.02; 248/441.1
See application file for complete search history.

(56) References Cited

U.S. PATENT DOCUMENTS 4,138,083 A * 2/1979 Spiegel ..... A47G 1/24 248/474
4,596,372 A * 6/1986 Ford ..... A47B 23/04 248/157
5,501,603 A * 3/1996 Mueller ..... B43L 1/04 40/610
5,518,217 A 5/1996 Deutsch et al.
5,697,595 A * 12/1997 Sperber ..... A47B 97/001 248/125.1
5,714,215 A 2/1998 Sheffield et al.
5,941,713 A * 8/1999 Wayner ..... B43L 1/06 248/441.1
6,170,379 B1 1/2001 Taylor
(Continued)

FOREIGN PATENT DOCUMENTS

WO 2012018986 A1 2/2012
WO 2014127400 A1 8/2014

OTHER PUBLICATIONS

Global; globalindustrial.com; "Mobile Office Partition Panel with Whiteboard", at least as early as Mar. 19, 2018, one page.
(Continued)

*Primary Examiner* — Kurt Fernstrom
(74) *Attorney, Agent, or Firm* — Pearne & Gordon LLP

(57) ABSTRACT

A ballistic presentation board includes a presentation board and a ballistic layer, the ballistic layer being attached to the back of the presentation board. The ballistic presentation board provides at least National Institute of Justice Level IIA ballistic protection. The ballistic presentation board can be attached to a wheeled stand to provide a ballistic presentation board assembly which can be pushed against a doorway during an attack to protect from gunfire, etc.

20 Claims, 3 Drawing Sheets

(56) References Cited

U.S. PATENT DOCUMENTS

| | | | | |
|---|---|---|---|---|
| 6,626,303 | B1 | 9/2003 | Moodie | |
| 6,647,652 | B1 * | 11/2003 | Seiber | G09F 7/18 40/606.1 |
| 6,941,691 | B2 * | 9/2005 | Arko | G09F 15/0012 248/451 |
| 6,969,037 | B2 * | 11/2005 | Eby | A47B 23/042 248/444 |
| 8,701,544 | B2 | 4/2014 | Peters et al. | |
| 8,850,949 | B1 | 10/2014 | Lopez | |
| 9,027,810 | B1 * | 5/2015 | Piersol | A45C 5/02 224/576 |
| 9,526,330 | B2 | 12/2016 | Weijian | |
| 9,669,650 | B2 | 6/2017 | Shen et al. | |
| 9,908,363 | B2 | 3/2018 | Oh | |
| 9,982,968 | B2 * | 5/2018 | Thomas | F41H 5/08 |
| 2009/0029338 | A1 * | 1/2009 | Kang | G09F 7/00 434/430 |
| 2012/0152096 | A1 | 6/2012 | Peters | |
| 2013/0323707 | A1 * | 12/2013 | Lyons | B43L 1/12 434/416 |
| 2014/0199678 | A1 * | 7/2014 | Tunis | B43L 1/00 434/408 |
| 2016/0003583 | A1 | 1/2016 | Harwood et al. | |

OTHER PUBLICATIONS

Uline; "Dry Erase/Dry Erase Partition—4×6' H-5860"; at least as early as Mar. 19, 2018; one page.

Safe Place Solutions; "Functional & Practical Front-line Ballistic Protection Solutions"; Sep. 6, 2016; three pages.

* cited by examiner

BALLISTIC PRESENTATION BOARD ASSEMBLY

This application claims the benefit of U.S. Provisional Patent Application No. 62/326,387 filed on Apr. 22, 2016, the entire contents of which are incorporated herein by reference.

FIELD OF THE INVENTION

The invention relates to presentation boards and in particular to a ballistic presentation board, preferably a presentation board on a wheeled stand providing ballistic protection.

DESCRIPTION OF RELATED ART

Presentation boards with and without stand in public places such as shopping malls, schools, plazas, post offices, court rooms, etc. are well known. Typically, these presentation boards are made out of plastic, metal or wood and are mounted on a stand but are not designed to provide protection in case of an attack such as gunfire, grenades, etc. Particularly for schools, universities, businesses, offices and facilities, there is a need for a presentation board preferably with stand which provides ballistic protection to people inside the facility who are under threat or attack and which is easy to move, assemble and disassemble.

SUMMARY OF THE INVENTION

A ballistic presentation board comprising a presentation board and a ballistic layer, the ballistic layer being attached to the back of the presentation board. The ballistic presentation board provides at least National Institute of Justice Level IIA ballistic protection. The ballistic presentation board can be attached to a wheeled stand to provide a ballistic presentation board assembly.

DETAILED DESCRIPTION OF PREFERRED EMBODIMENTS OF THE INVENTION

Figure 1:
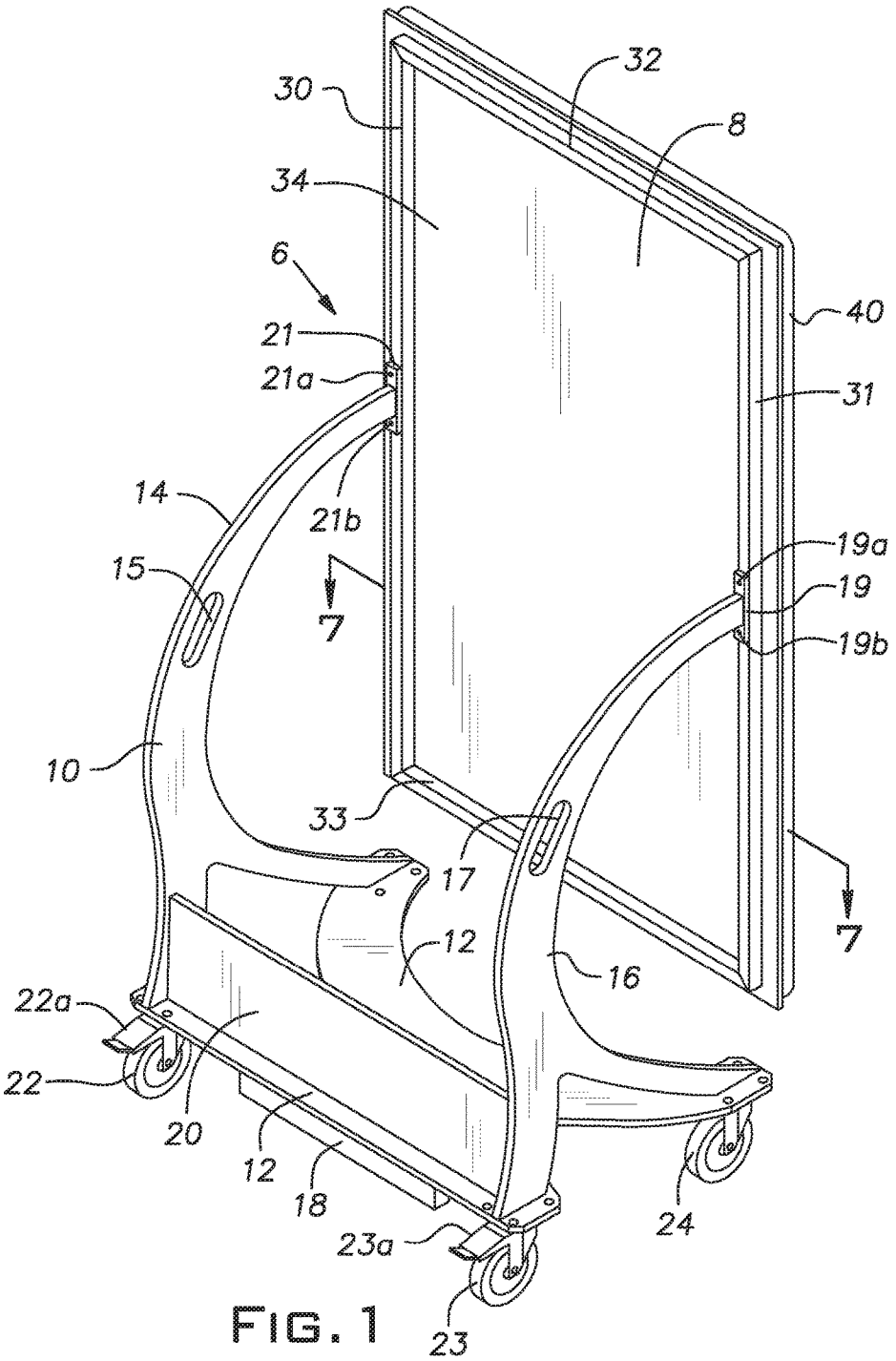
FIG. 1 is a back-right perspective view of a ballistic presentation board assembly or a presentation board with stand according to the invention.

In the description that follows, when a preferred range, such as 5 to 25 (or 5-25) is given, this means preferably at least 5 and, separately and independently, preferably not more than 25. As used herein and in the claims, NIJ Levels IIA, II, IIIA, III or IV means National Institute of Justice Levels IIA, II, IIIA, III or IV as of December 2014. As used herein, "presentation board" includes dry-erase board, whiteboard, magnetic whiteboard, markerboard, display board (suitable for receiving push-pins to hold papers onto the display board; the display board can be fabric-covered), chalkboard, pegboard and corkboard as known in the art. As used herein, ballistic or ballistic material or ballistic layer (or combination of layers) means that it provides at least National Institute of Justice (NIJ) (December 2014) Level IIA ballistic protection.

With reference to FIGS. 1-7, there is shown a ballistic presentation board assembly 6 comprising a ballistic presentation board 8 and a stand 10. The stand 10 includes a base 12, a left side mount 14, and a right side mount 16, all preferably 0.5 inch steel and preferably welded together. Handhold openings 15, 17 are provided in the side mounts 14, 16, respectively. Back wheels or caster wheels 22, 23 (preferably with brakes or locks 22*a*, 23*a* respectively) and front wheels or caster wheels 24, 25 (with or without brakes/locks) are attached to the bottom of base 12.

A heavy counterweight 18, preferably steel, preferably at least 20, 30, 40, 50 or 60 lbs.; optionally not more than 40, 50, 60, 80, 100, 120 or 140 lbs., is attached (preferably so that it is disattachable from the stand without damage) and preferably via bolts 26, 27, to the bottom of base 12. A cross plate 20, preferably about 26-36, or 30-33 or about 31.5 inches long and 7-9 or about 8 inches high, preferably steel, preferably ballistic, is attached to the base 12 and side mounts 14, 16, preferably via welding.

The ballistic presentation board 8 comprises a presentation board 39 and a ballistic layer or panel or member 34. The presentation board 39 comprises a presentation surface or presentation surface member 38 (such as the marking surface of a whiteboard) and a presentation support member or substrate 36. If the presentation board is a dry-erase or whiteboard, it typically has a thin presentation surface 38 and a presentation support member or substrate 36 which can be wood, plastic and/or aluminum, preferably in solid, rigid foam or honeycomb configuration, typically ⅜ inch to 1 or 1.25 inches thick. A magnetic whiteboard includes a thin steel sheet 1/16 to 1/32 inch and down to 0.016 mm thick behind the presentation surface. A cork board has a cork presentation surface and a substrate; a chalkboard has a chalkboard presentation surface and a substrate. A markerboard is known in the art and is similar to a whiteboard. A display board has a presentation surface (which can receive push-pins) and a substrate.

First and second vertical frame members 30, 31 and first and second horizontal frame members 32, 33 (preferably 1"×1" hollow square tubing with 0.12" wall thickness) are attached, preferably via welding, to the back of ballistic layer 34.

Right bolt plate 19 is welded to the end of right side mount 16; left bolt plate 21 is welded to the end of left side mount 14; bolts 19*a*, 19*b* and 21*a*, 21*b* are then used to removably attach the ballistic presentation board 8 to the stand 10 (so that the board 8 is disattachable from the stand 10 without damage). A perimeter edge protector 40, preferably hard rubber or metal, can be provided around the perimeter of the presentation board 39 and optionally around the perimeter of the ballistic layer 34.

To provide a nice appearance, the steel parts of the stand 10 and the ballistic layer or panel 34 are prepared by blasting, then all edges are broken, then the metal is powder coated, all as known in the art.

Figure 8:
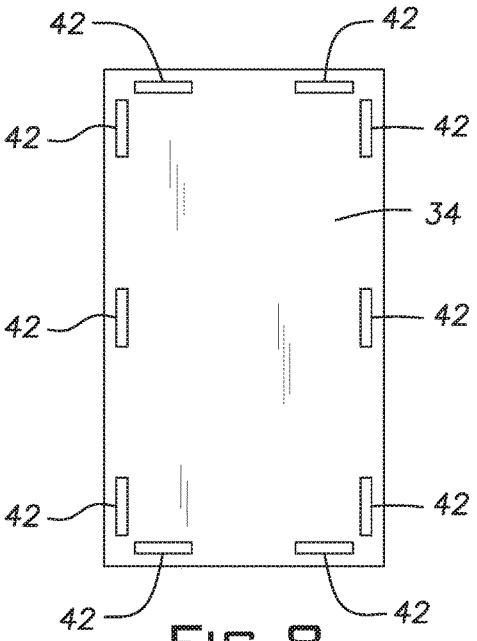
FIG. 8 is an elevational view of the front of the ballistic layer 34 which faces the back of the presentation board 39.

FIG. 8 shows the front surface of the ballistic layer 34 which faces the back of the presentation board 39; these surfaces are removably joined together (so that they are disattachable from each other without damage) preferably by hook and loop fasteners. For example, strips 42 of hook fastener are adhesively attached to the front of layer 34 as shown in FIG. 8; corresponding strips of loop fastener, which line up with the strips 42, are adhesively attached to the back of presentation board 39, that is, to the back of presentation support member or substrate 36. The two members 34, 39 are then pressed together to be held by hook and loop fasteners. The presentation board 39 can then be easily removed and replaced by a different size presentation board or by a different type of presentation board, etc. Similarly, the layer 34 and the counterweight 18 can be easily removed and replaced with members which are different size, type, weight, etc., since they are attached via bolts.

Ballistic layer 34 and preferably cross plate 20 provide at least NIJ Level IIA ballistic protection, more preferably at least NIJ Level II, IIIA, III or IV ballistic protection; they are preferably a plate or panel or sheet, optionally at least 0.1, ⅛, ¼, ⅜, ½ or ⅝ inch thick, optionally not more than ⅜, ½, ⅝, ¾, ⅞ or 1, inch thick, preferably 0.1 or ⅛ to 1 or ¼ to ¾, more preferably ¼ to ½ or ⅜ to ⅝ or ⅛ to ⅜, more preferably ⅛ to 3/16, or ⅛ to 1 or about ⅛ or about ¼ or about ⅜ or about ½, inch thick metal or steel, preferably hardened or martensitic steel, such as steel having a Brinell value of at least 225, 250, 300, 350, 400, 450, 500, 550, or 600. The NIJ Level of ballistic protection can be increased by increasing the thickness of the ballistic material, and/or increasing the hardness or martensitic value and/or increasing the Brinell value of the ballistic material. Aluminum or fiberglass can be used in place of steel in some cases. A plurality of layers stacked together can be substituted for a single layer. Less preferably, a plurality of small plates can be put and welded next to each other to resemble one large plate.

The presentation board 39 and the ballistic panel 34 are preferably the same size and are preferably the size of a conventional presentation board, such as 36" by 48" or 36" by 60" or 96" by 48" or 96" by 40" or 48" by 72", etc. The ballistic presentation board 8 is preferably mounted on the stand 10 so that the long dimension (e.g. 60" when it is 36"×60") is oriented vertically and the short dimension (e.g. 36") is oriented laterally or left-to right (see FIG. 3). The ballistic presentation board 8, the presentation board 39 and the ballistic panel 34 are preferably about 36 to 48 inches wide and 48 to 96 inches high. The bottom 44 of (a) the ballistic presentation board 8 and (b) the ballistic panel 34 is preferably at least 7, 8, 10, 12, 14, 15, 16, 18 or 20 inches above the floor (above the bottom of the wheels) and optionally not more than 36, 30, 25, 20, 18, 16, 15, 14 or 13 inches above the floor (above the bottom of the wheels); preferably about 10-15 or 11-14 or 12-13 inches above the floor (above the bottom of the wheels).

Figure 4:
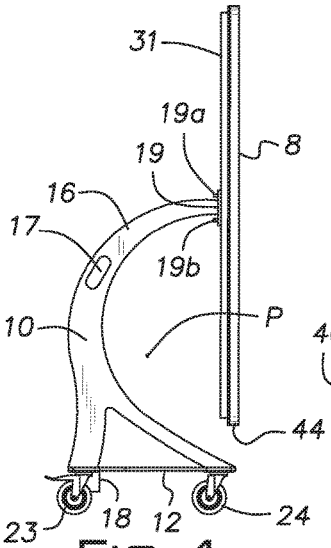
FIG. 4 is a right side elevational view thereof; the left side elevational view being a mirror image thereof.
Figure 6:
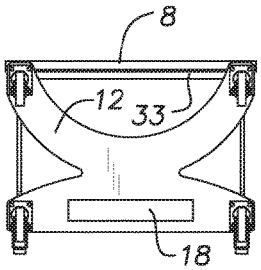
FIG. 6 is a bottom plan view thereof.
Figure 5:
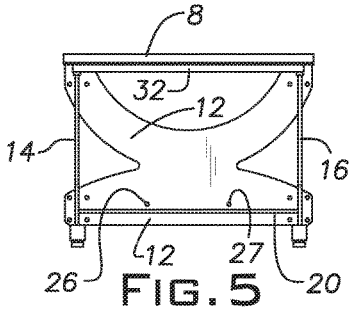
FIG. 5 is a top plan view thereof.
Figure 7:
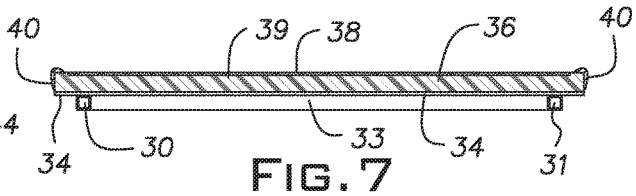
FIG. 7 is a cross-sectional view taken along line 7-7 of FIG. 1.

As shown in FIG. 4, a preferred feature is that the front of the presentation board 39 is the most forward part of the assembly 6. This is so that, if there is a threat, the assembly 6 can be pushed up against the door or doorway or window and the ballistic presentation board 8 will be substantially flush with the door/doorway/window. If the front wheels 24, 25 or the front of the base 12 extended in front of the board 8, they would be the first thing to contact the doorway, thus leaving a gap between the board 8 and the doorway, so that an intruder could reach through the gap and shoot a gun, or reach and grasp the edge of the board 8 and twist the assembly 6 out of the way.

Since the ballistic presentation board 8 is so far forward, the counterweight 18 is needed to prevent the assembly 6 from toppling over. The relative weights and locations of the components, especially the counterweight 18, are calculated or determined so that the center of gravity of the assembly 6 is located preferably (a) in a forward/back direction (see point P in FIG. 4), midway between (1) the center of the back wheels and (2) the center of the front wheels or within 10, 20, 30, 40, 50 or 60% of the midway point; (b) in a vertical direction (see point P in FIG. 4), midway between (1) the bottom of the ballistic presentation board 8 and (2) the bottom of the hand hold openings 15, 17 or within 10, 20, 30, 40, 50 or 60% of the midway point; (c) in a left/right direction (see point P in FIG. 2), midway between (1) the left wheels and (2) the right wheels or within 10, 20, 30, or 40% of the midway point. Alternatively, the center of gravity of the assembly 6 is located, in a vertical direction (see point P in FIG. 4), at least 10, 12, 14, 16, 18, 20, 22, 24, 26, 28 or 30 inches above the bottom of the wheels and optionally not more than 40, 38, 36, 34, 32, 30, 28, 26, 24, 22, 20, 18, 16 or 14 inches above the bottom of the wheels (e.g., above the floor). The preferred center of gravity described above is shown approximately at point P in FIGS. 2 and 4. Typically the weight of the ballistic presentation board 8 will be determined (largely dependent on the weight of the ballistic panel 34); then the weight and location of the counterweight 18 can be determined so that the center of gravity is in the correct place.

Figure 2:
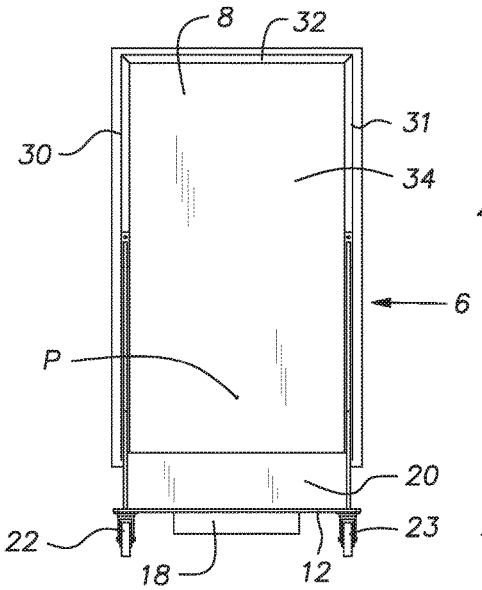
FIG. 2 is a back elevational view thereof.
Figure 3:
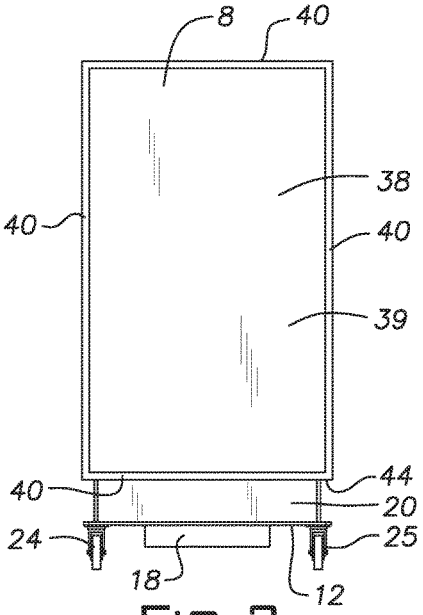
FIG. 3 is a front elevational view thereof.

As can be seen in FIGS. 1-3, cross plate 20 extends in a plane substantially parallel to a plane defined by ballistic layer 34, and is preferably high enough so that it extends preferably 0.1-3 or ½-2 or 1-2 or 1.5-3, inches above the bottom of ballistic panel 34, so that, from a horizontal line of sight, there is no gap where a horizontal bullet could fly through, for example, so that there is no gap between (1) at least a portion of the bottom of the ballistic layer 34 and (2) at least a portion of the top of the ballistic cross plate. The presence of counterweight 18 beneath the base 12 (see FIGS. 2-3) also provides additional protection from horizontal bullets.

Figure 10:
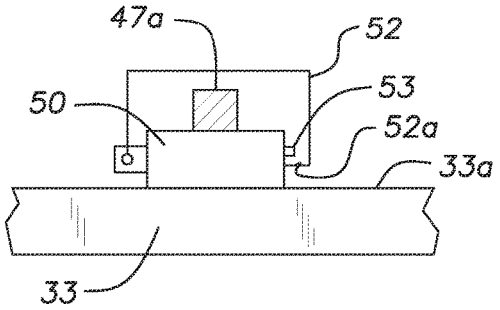
FIG. 10 is a front view of a resting block 50 for use with tip 47*a* shown in FIG. 9.
Figure 9:
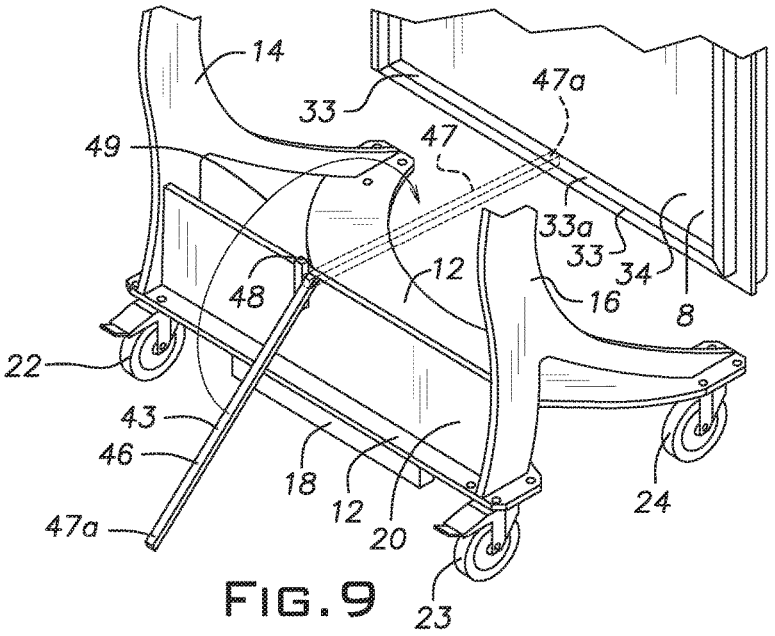
FIG. 9 is a perspective view of the bottom portion of FIG. 1, showing the addition of a stoppage device.

With reference to FIG. 9, there is shown a stoppage device 46 comprising an arm 43 and a bracket 48 which is attached to the top of cross plate 20 as shown, preferably via welding. When the stoppage device 46 is deployed as shown, it is at an angle as shown, preferably 30-60 or about 45, degrees with respect to vertical as shown, in order to contact the floor and help prevent the assembly 6 from being pushed backward by an intruder or being pushed, or falling over, backward. When deployed, the arm 43 is locked at bracket 48 by a conventional locking mechanism. The arm 43 can then be stored by unlocking it at the bracket 48, rotating it through arc 49 through a vertical plane, until it reaches position 47 (shown in phantom) where the tip 47*a* of arm 43 rests on the top 33*a* of second horizontal frame member 33. Optionally as shown in FIG. 10, the tip 47*a* can rest on a resting block 50 (such as a cube or parallelepiped of metal or wood or plastic) fixed to the top 33*a* of member 33 and optionally extending toward cross plate 20 from top 33*a* to accommodate the length of arm 43. The block 50 can optionally have a locking arm 52 hinged to block 50 and swinging over tip 47*a* to lock tip 47*a* in place via tip 52*a* releasably engaging catch 53.

The ballistic presentation board assembly 6 can be used in schools, classrooms, assembly halls or rooms, offices, conference rooms, anywhere presentation boards such as whiteboards are currently used. When there is a security threat such as a shooter or intruder or assailant, you unlock the casters or wheels, grab the hand holds, push the assembly 6 until the ballistic presentation board 8 is flush or substantially flush or as flush as possible with the door, doorway or window. Then you lock the casters or wheels and the stoppage device 46 in deployed position. The ballistic and steel elements protect from bullets, projectiles, etc.

While the invention has been described with reference to the preferred embodiments, it is understood that various changes can be made and equivalents may be substituted for elements thereof without departing from the scope of the invention.

What is claimed is:

1. A ballistic presentation board comprising a presentation board and a ballistic layer, the ballistic layer being attached to the back of the presentation board, the ballistic presentation board providing at least NIJ Level IIA ballistic protection, the ballistic presentation board further comprising a stand, the ballistic presentation board being fixed to the stand, the ballistic presentation board and the stand together forming a ballistic presentation board assembly, wherein a plurality of wheels are attached to a bottom of the stand, wherein a counterweight is attached to the stand, wherein the counterweight is disattachable from the stand without damage.

2. The ballistic presentation board of claim 1, wherein the ballistic presentation board provides at least NIJ Level II ballistic protection.

3. The ballistic presentation board of claim 1, wherein the ballistic presentation board provides at least NIJ Level IIIA ballistic protection.

4. The ballistic presentation board of claim 1, wherein the ballistic presentation board provides at least NIJ Level III ballistic protection.

5. The ballistic presentation board of claim 1, wherein the ballistic presentation board provides at least NIJ Level IV ballistic protection.

6. The ballistic presentation board of claim 1, wherein a presentation surface member is provided on a front of the presentation board, wherein the front of the presentation board is the most forward part of the ballistic presentation board assembly.

7. The ballistic presentation board of claim 6, wherein 2 front wheels and 2 back wheels are attached to the bottom of the stand, the ballistic presentation board assembly having a center of gravity; with respect to a forward/back direction, the center of gravity being located between (1) the center of the back wheels and (2) the center of the front wheels.

8. The ballistic presentation board of claim 7, with respect to a vertical direction, the center of gravity being located nor more than 40 inches above the bottom of the wheels.

9. The ballistic presentation board of claim 1, wherein the ballistic presentation board is disattachable from the stand without damage.

10. The ballistic presentation board of claim 1, wherein the presentation board is disattachable from the ballistic layer without damage.

11. The ballistic presentation board of claim 10, wherein the presentation board is attached to the ballistic layer by hook and loop fasteners.

12. The ballistic presentation board of claim 1, wherein at least 2 handhold openings are provided in the stand.

13. The ballistic presentation board of claim 1, wherein the stand comprises a base, the counterweight extending downwardly from a bottom of the base.

14. The ballistic presentation board of claim 1, wherein the presentation board is a whiteboard.

15. The ballistic presentation board of claim 1, wherein a stoppage device is attached to the stand.

16. A ballistic presentation board comprising a presentation board and a ballistic layer, the ballistic layer being attached to the back of the presentation board, the ballistic presentation board providing at least NIJ Level IIA ballistic protection, the ballistic presentation board further comprising a stand, the ballistic presentation board being fixed to the stand, the ballistic presentation board and the stand together forming a ballistic presentation board assembly, wherein the stand comprises a base and a ballistic cross plate, the ballistic cross plate extending in a plane substantially parallel to a plane defined by the ballistic layer, the ballistic cross plate extending upward a sufficient distance so that, from a horizontal line of sight, there is no gap between (1) at least a portion of a bottom of the ballistic layer and (2) at least a portion of a top of the ballistic cross plate.

17. The ballistic presentation board of claim 16, wherein a plurality of wheels are attached to a bottom of the stand, and wherein the ballistic presentation board provides at least NIJ Level III ballistic protection.

18. The ballistic presentation board of claim 16, wherein a presentation surface member is provided on a front of the presentation board, wherein the front of the presentation board is the most forward part of the ballistic presentation board assembly.

19. The ballistic presentation board of claim 16, further comprising a counterweight attached to the stand.

20. The ballistic presentation board of claim 19, wherein the counterweight is disattachable from the stand without damage.

* * * * *